US005188405A

United States Patent [19]

Maccaferri

[11] Patent Number: 5,188,405

[45] Date of Patent: Feb. 23, 1993

[54] LOCKING DEVICE FOR A LATCH

[75] Inventor: Marco Maccaferri, Louisville, Ky.

[73] Assignee: Rev-A-Shelf, Inc., Jeffersontown, Ky.

[21] Appl. No.: 665,324

[22] Filed: Mar. 6, 1991

[51] Int. Cl.[5] ..... E05C 3/22

[52] U.S. Cl. ..... 292/204; 292/251.5; 292/210; 292/336; 70/413

[58] Field of Search ..... 292/201, 251.1, 203, 292/204, 103, 108, 210, 211, 194, 336, DIG. 24, DIG. 12, 338; 70/276, 413

[56] References Cited

U.S. PATENT DOCUMENTS

| | | | |
|---|---|---|---|
| 260,693 | 7/1882 | Lee | 292/108 |
| 614,429 | 11/1898 | Bird | 292/210 |
| 785,367 | 3/1905 | Mason | 292/108 |
| 1,584,637 | 5/1926 | Neuviller | 292/338 |
| 1,596,451 | 8/1926 | Rawlings | 292/338 |
| 4,919,464 | 4/1990 | Richards | 292/201 |

*Primary Examiner*—Renee S. Luebke
*Assistant Examiner*—D. Boucher

[57] ABSTRACT

A magnetically operated latch including a pivotally attached magnetic latching means engageable with an aubtment, but disengageable when brought into magnetic contact with a key magnet. A pivotably movable lock is provided to prevent reengagement with the abutment when the key magnet is disengaged from magnetic contact with the magnetic latching means.

4 Claims, 2 Drawing Sheets

LOCKING DEVICE FOR A LATCH

BACKGROUND OF INVENTION (1) Field of the Invention

This invention relates to a locking device for a latch and more particularly relates to a locking device for a magnetically operated latch member and even more particularly relates to a locking device for a pivotally mounted magnetically operated latching means.

(2) Description of the Prior Art

There are a number of latching means known in the art which utilize magnetic means to engage and disengage the latching member. A number of these devices are particularly useful, such as the closure mean for doors for kitchen cabinets, furniture, and the like, wherein the operation of the magnetic latch is by a second magnet which is kept distinct from the closure means or the magnetic latch for which it operates. Particular applications for these types of magnetic closure means are to prevent small children from getting into areas in the home in which the contents within the enclosures may be harmful. However, many of these magnetic closure means which in normal use are in a latching position are not always appropriate or desirable as the latching means has to always be operated by a second remote magnet. In many instances when small children are not around, it may be desirable to maintain the closure or latching means in a disengaged position instead of a latching or engaging position. For example, grandparents of small children may have a magnetically operated latching device on kitchen cabinets, which they may wish to have engaged when their young grandchildren are in their home, but when the young grandchildren are away, find it inconvenient to continually have to use a magnetic key to disengage the latching member whenever they need to get into an enclosure.

One particular useful magnetically operated latching means is described in U.S. Pat. No. 4,919,464. However, in the use of the magnetic latching mechanism described in this patent, once the mechanism has been installed on, for example, a kitchen cabinet door, it is always necessary to utilize a second remote magnetic key to disengage the magnetic latching means from an engaged position.

SUMMARY OF THE INVENTION

An object of the present invention is to provide a lock for a latching device. Another object of the present invention is to provide a lock for a latching device for locking the latching device in a disengaging position. A further object of the present invention is to provide a lock for a magnetically operated latching device. Even further, an object of the present invention is to provide a lock for a magnetically operated latching device which utilizes a second magnetic device to disengage a latching device from its normally engaged or latching position.

More particularly, the present invention is to provide a lock in combination with a latch which comprises an abutment for latching the latch, a pivotable latching means having an abutment engaging position for latching engagement with the abutment, pivot means for pivotally mounting the latching means to a support therefore, wherein the improvement comprises a lock pivotally attached to the support, the lock including locking means engageable with the latching means to prevent movement of the latching means when the latching means is in a disengaged position with the abutment.

It is to be understood that the invention of the examples of the present invention given hereinafter are not by way of limitation and various modifications within the scope of the present invention will occur to those skilled in the art upon reading the disclosure set forth hereinafter.

BRIEF DESCRIPTION OF THE DRAWING

Referring to the drawing.

DESCRIPTION OF THE PREFERRED EMBODIMENT

Figure 1:
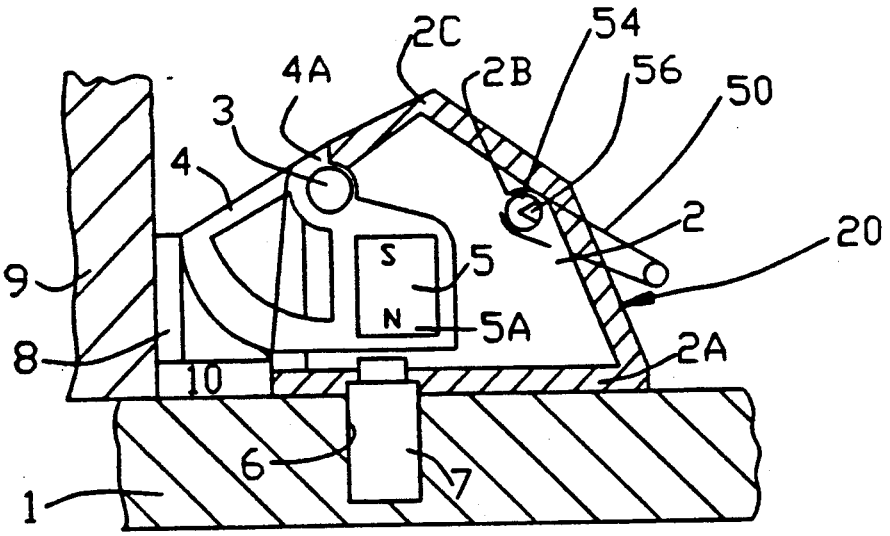
FIG. 1 shows a diagrammatic, horizontal sectional view of a magnetically operated latch for latching a door leaf to a door jam and lock of the present invention, when the latch is in an engaging position and the lock is in a unlocking position.
Figure 2:
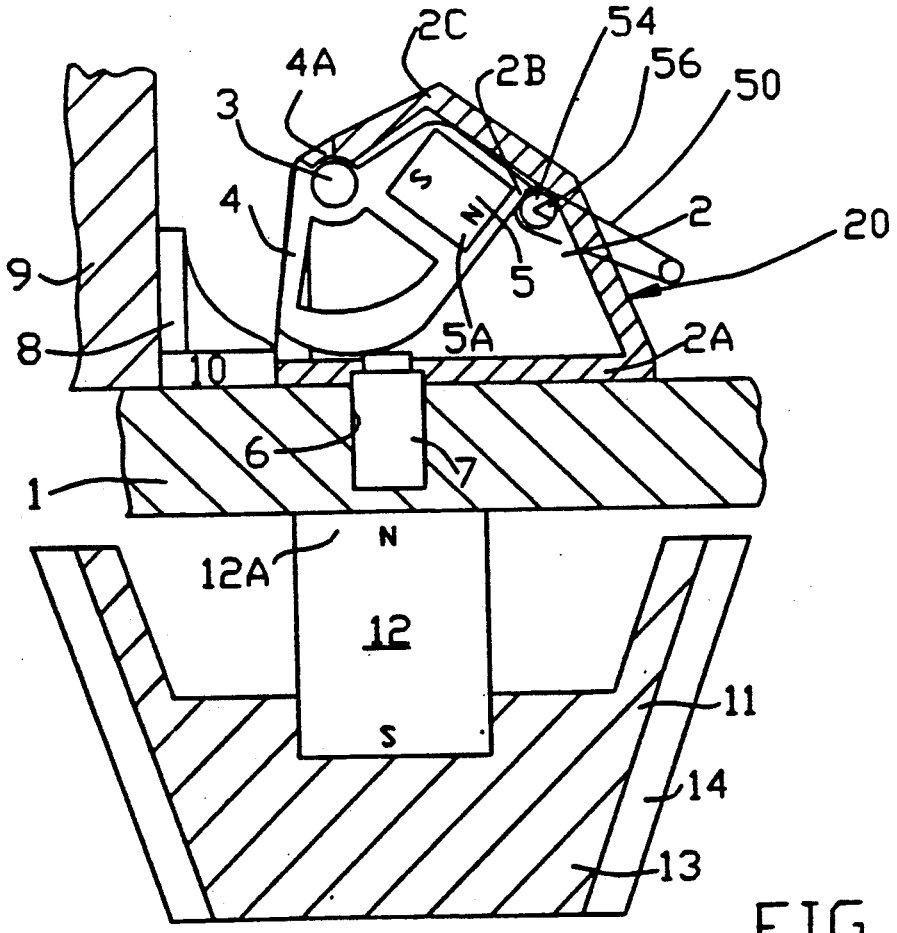
FIG. 2 shows a diagrammatic, horizontal sectional view of a magnetically operated latch for latching a door leaf to a door jam and lock of FIG. 1, when the magnetically operated latch is in a disengaged position and the lock is in an unlocking position.
Figure 3:
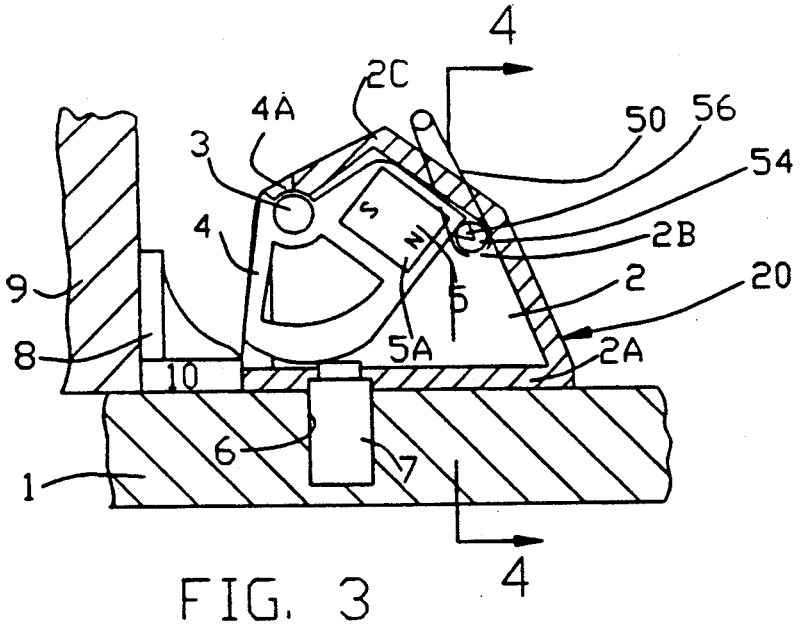
FIG. 3 shows a diagrammatic, horizontal sectional view of a magnetically operated latch for latching a door leaf to a door jam and lock of FIG. 1, wherein the lock is in a locking position to prevent the magnetically operated latch from engagement with a door jam; and, FIG. 4 is a cross-sectional view taken in a plane passing through Line 4—4 of FIG. 3.

FIGS. 1-3 show a magnetically operated latch 20 designed to be fixed to door leaves of, for example, articles of furniture. The latch 20 is shown attached to a door leaf 1 and includes a body 2 secured by screws to the door leaf 1. The body 2 houses an extendable latching member 4 that is turnable within the body 2 about a vertical axis 3 so as to be able to extend from or be withdrawn into the body 2.

The member 4 fixedly carries at one end a driving member 5 in the form of a permanent magnet and can be releasably engaged with its other end against an abutment 8 affixed to the door jam 9. The body 2 comprises a vertical face wall 2A, two horizontal side walls 2B, and a vertical shielding wall 2C. The member 4 is pivotally mounted with plain bearings in the respective walls 2B and is preferably formed with a detent 4A for abutting against the wall 2C to limit the degree of turning of the member 4 clockwise about the axis 3 in its latching position as shown in the Figures. Fitted co-axially in a drilled bore 6 in the leaf 1 is a rod 7 of magnetically soft material, which is preferably mild steel, shouldered at its inner end to fit into a shouldered bore 10 in the wall 2A. One pole 5A of the member 5 is arranged face-to-face with that inner end at a spacing therefrom and urges the member 4 into its latching position as shown in FIG. 1. A magnetic key in the form of a permanent magnet 12 is mounted in a non-metallic housing 13, which is formed with, for example, fluting 14, for gripping by the user's finger and thumb at its exposed pole 12A of the same polarity as the pole 5A. Therefore, when the magnetic key 11 is applied in the vicinity of the rod 7, as shown on the outside of door leaf 1, the member 5 is magnetically repelled away from the magnetic key 11 and thusly, the member 4 moves anti-clockwise until it is withdrawn into the body 2. The magnetic attraction between the member 5 and the magnet 12 is sufficient, as shown in FIG. 2, to maintain the member 4 in a disengageable position, as long as the magnet 12 is in magnetic cooperation with the member 5.

Figure 4:
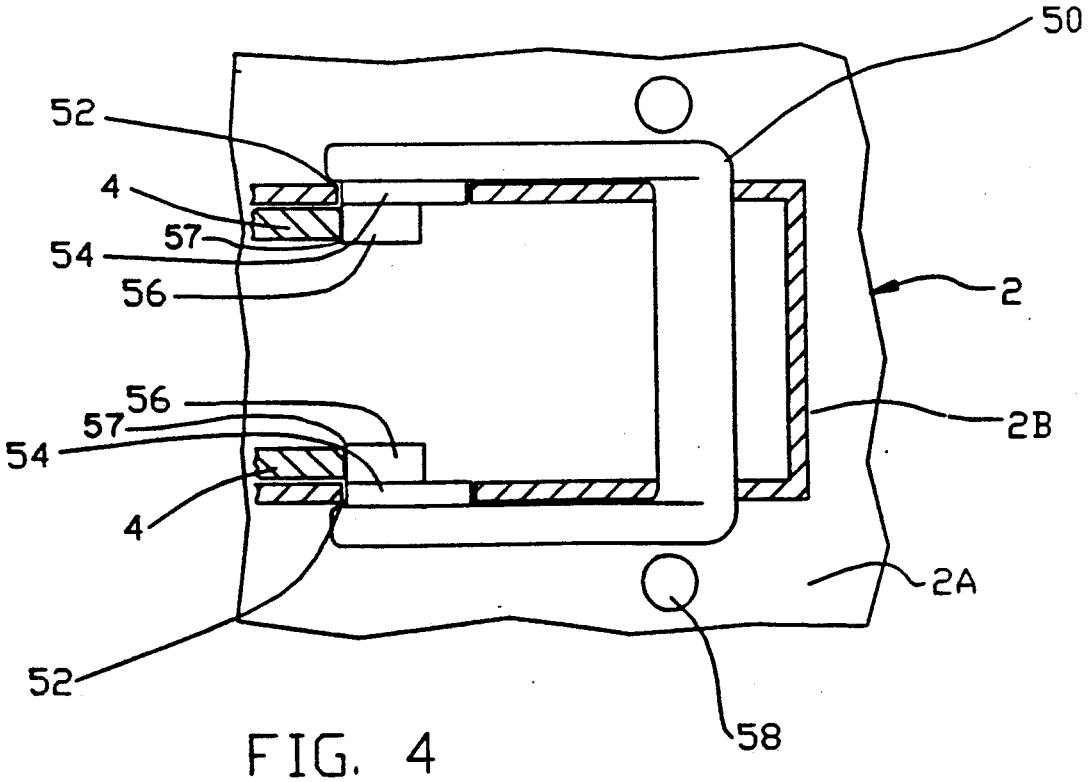

Lock 50, as best shown in FIG. 4, is pivotally mounted into the body 2. A preferred lock 50 is of generally U-shaped construction with turnable ends being pivotally attached to opposite sidewalls 2B of the body 2. The sidewalls 2B include a pair of aligned apertures 52 therein to receive inwardly extending bearings 54 which are unitary with and at the turnable ends of the U-shaped lock 50. The outer diameter of the bearings 54 are substantially of the same diameter as the apertures 52. Attached to each of the bearings 54 and extending inwardly therefrom, is a pair of wedged-shaped friction engaging extensions 56. The base of the wedge-shaped extensions 56 are of the same configurations and in the same plane as the outer most portion of the bearing 54. As shown in FIGS. 3 and 4, the latching member 4 is spaced inwardly from the walls of the body 2A so that when in a locked position the friction engaging portion 57 of the wedged-shaped extension 56 is in friction engagement with the latching member 4 whereas as shown in FIGS. 1 and 2, when the lock 50 is pivoted to an unlocking position, the friction engaging portion of the lock 50 is pivoted away from engagement with the latching member 4.

In operation, when the magnetic key 11 is removed from the vicinity of the rod 7, the member will be attracted back towards the rod 7, thereby returning the latch to a latching or engaging condition, as shown in FIG. 1. However, as shown in FIG. 2, when the magnetic key is in the vicinity of rod 7, the member 5 will be attracted toward the magnet 12, thereby disengaging the member 4 from its engaging position. As shown in FIGS. 1 and 2, the lock 50 is pivoted so that the wedged-shaped friction engaging extension 56 is positioned away from the member 4. However, the lock 50, as shown in FIGS. 3 and 4, is pivoted in a position so that the friction engaging extension 56 is in friction engaging contact with the member 4 and member 4 is prevented from movement into an engaging position with the door jam 1. The friction engaging extension 56 is provided with sufficient friction holding power so as to prevent the member 4, and particularly the magnetic pole 5A, from being attracted back towards the rod 7, thereby returning the latch to a latching condition.

Generally, apart from the two magnets 5 and 12, and the steel rod 7, all other parts of the latch and lock are made of non-magnetic materials such as, for example, aluminum, brass, plastics and the like.

The magnetic key 11 is designed so that the pole 12A is more naturally applied to the door leaf by the user.

It is realized that various changes may be made to the specific embodiment shown and described without departing from the principals of the present invention.

What is claimed is:

1. An improvement in a latch comprising:

An abutment for latching said latch; a pivotable latching means having an abutment engaging portion for latching engagement with said abutment; pivot means for pivotally mounting said latching means to a support therefore; the improvement comprising: a lock pivotally attached to said support, said lock including locking means to engage with said latching means to prevent movement of said latching means when the latching means is in a disengaged position with said abutment, said locking means being a U-shaped member with turnable ends pivotally attached to said support, said turnable ends including friction engaging means to engage with said latching means in a locking position, said locking means includes a pair of spaced inwardly extending bearings at the turnable ends of said U-shaped member, said pair of spaced friction engaging means extending inwardly from said bearings.

2. The improvement of claim 1 wherein said friction engaging means is of wedge-shaped configuration, the base of said wedge being in the same plane as the outer most portion of said bearings.

3. An improvement in a latch comprising:

an abutment for latching said latch; a pivotable latching means for latching engagement with said abutment, said latching means having an abutment engaging portion and a first permanent magnet, pivot means for pivotally mounting said latching means to a support therefore wherein said engaging portion and said first permanent magnet are pivotable about said pivot means between a latched position when said engaging portion engages said abutment, and in an unlatched position when said engaging portion does not engage the abutment; magnetic material means disposed adjacent to said latching means and in a position wherein the said latching means is pivotable about said pivot means so that said first permanent magnet is attracted to said magnetic material means and placed in juxtaposition therewith, whereby the said engaging position is maintained only in said latched position; a second magnet wherein the disposition of said first permanent magnet in said latching means is in relation to said engaging portion and said pivot means such that said second magnet is positioned to act repulsively upon said first permanent magnet to pivot said latching means to said unlatched condition and wherein, in the absence of said second magnet, the latching means is only in said latched condition, the improvement comprising: a lock pivotally attached to said support, said lock including locking means to engage with said latching means to prevent movement of said latching means to a latching condition in the absence of said second magnet, said locking means being a U-shaped member having turnable legs disposed on opposite sides of said latching means, said lock having friction engaging means on said legs, whereby in one position the friction engaging means is engaging with said latching means and in an unlocked position, the friction engaging means is pivoted away from engaging with said latching means, said friction engaging means includes a pair of spaced inwardly extending bearings at the turnable ends of said U-shaped member and a pair of spaced friction engaging means extending inwardly from said bearings.

4. The improvement of claim 3 wherein said friction engaging means is of wedged-shaped configuration, the base of said wedge being in the same plane as the outer most portion of the bearings.

* * * * *